US006308831B1

(12) United States Patent
Saxe et al.

(10) Patent No.: US 6,308,831 B1
(45) Date of Patent: Oct. 30, 2001

(54) CONTAINER AND KIT FOR PROTECTION AND DISPLAY OF COLLECTIBLE ITEMS

(75) Inventors: Joel E. Saxe; Thomas F. O'Keefe; Sam G. Fretta, all of Portland; Larry K. Kiggans, Clackamas; Radu D. Luca, Gresham; David M. Hebert, Portland, all of OR (US)

(73) Assignee: J. E. Saxe & Co., Portland, OR (US)

( * ) Notice: Subject to any disclaimer, the term of this patent is extended or adjusted under 35 U.S.C. 154(b) by 0 days.

(21) Appl. No.: 09/522,330

(22) Filed: Mar. 9, 2000

Related U.S. Application Data

(60) Provisional application No. 60/143,388, filed on Jul. 12, 1999.

(51) Int. Cl.[7] ..... B65D 85/48; G09F 1/12

(52) U.S. Cl. ..... 206/449; 40/661; 206/38; 206/39

(58) Field of Search ..... 206/449, 454, 206/38, 39; 40/661

(56) References Cited

U.S. PATENT DOCUMENTS

| | | | | |
|---|---|---|---|---|
| 2,728,450 | | 12/1955 | Haire . | |
| 2,758,772 | | 8/1956 | Williams . | |
| 3,150,457 | | 9/1964 | Thieme . | |
| 3,486,263 | | 12/1969 | Larsson . | |
| 4,322,001 | | 3/1982 | Hurley . | |
| 4,759,838 | * | 7/1988 | Mayes et al. | 206/454 X |
| 4,829,691 | * | 5/1989 | Manjos et al. | 40/661 |
| 4,918,299 | | 4/1990 | Ohmori . | |
| 4,979,619 | | 12/1990 | Hager . | |
| 5,046,616 | | 9/1991 | Makowski et al. . | |
| 5,097,953 | | 3/1992 | Gingras . | |
| 5,125,505 | * | 6/1992 | Kurosaki | 206/38 X |
| 5,224,600 | * | 7/1993 | Neugebauer | 206/449 |
| 5,344,015 | * | 9/1994 | Carlin et al. | 206/449 |
| 5,353,925 | | 10/1994 | Lennon et al. . | |
| 5,363,964 | | 11/1994 | Hexter, Jr. . | |
| 5,415,290 | | 5/1995 | Merkley et al. . | |
| 5,429,238 | | 7/1995 | Fritz . | |
| 5,522,163 | * | 6/1996 | Neugebauer | 40/661 X |
| 5,577,609 | * | 11/1996 | Hexter, Jr. | 206/449 |

* cited by examiner

*Primary Examiner*—Byron P. Gehman
(74) *Attorney, Agent, or Firm*—ipsolon llp

(57) ABSTRACT

A container for storage and display of collectible items is disclosed. The container includes a lid and plural base units that are sized to snugly fit a particular size of collectible item within a category of collectible items. The base units define a receptacle that receives the collectible item. In order that the collectible item is snugly fit into the receptacle for optimum protection, the base unit includes sizer members that extend into the receptacle to reduce dimensions of the receptacle. The lid is sized to fit plural base units, having different sizer members. Accordingly, containers may be provided for a category of differently sized collectible items, wherein the container have uniform exterior dimensions to provide aesthetically pleasing display containers. The base units further include stiffening ribs to provide support for relatively heavy, flexible collectible items. Also, posts and post receptacles are formed in the lid and base units, respectively, to assist with a secure coupling of the lid and base units.

9 Claims, 2 Drawing Sheets

CONTAINER AND KIT FOR PROTECTION AND DISPLAY OF COLLECTIBLE ITEMS

This application claims benefit of Prov. No. 60/143,388 filed Jul. 12, 1999.

BACKGROUND OF THE INVENTION

1. Field of the Invention

This invention pertains to the field of containers for storage, protection, and display of collectible items such as magazines, books, and other substantially planar items.

2. Description of the Related Art

Collectible items such as magazines, trading cards, newspapers and LP album covers retain greater value when they are maintained in good condition. Collectible items that have damaged corners and edges, creases, or that show UV degradation due to exposure to sunlight, have significantly less value than collectible items without such damage. Collectible items stored in plastic sleeves which the item to be slid into the sleeve through a top opening can also cause wear damage to a cover of a collectible item.

Accordingly, containers are used for safekeeping collectible items. An example is shown in U.S. Pat. No. 5,097,953 that discloses a container for sports trading cards. The container consists of two mating halves that enclose a trading card in a recess between the mating halves. The recess includes corner indentations to protect corners of the trading cards from damage. Such containers are useful for protecting items such as trading cards that have a uniform shape and size. In addition, trading cards traditionally are made of a stiff card stock that is self-supporting. Further, the compact size of trading cards permits the container to have a relatively small display window that can easily be made self-supporting, without bowing, using traditional clear materials such as plastic.

Several problems are evident in the prior art. A snug fit of the trading card in the container is desirable to properly protect the card. To ensure a snug fit, the container must have suitable dimensions for each size and shape of collectible item to be stored in the container. Accordingly, a different container must be made to accommodate each different size and shape of collectible item which necessarily requires numerous molds, storage, and inventory tracking. Each of these factors adds cost to products in an industry that relies upon high-volume sales of low margin items, and is thus undesirable.

The above discussed U.S. Pat. No. 5,097,953 receives trading cards that are made of sturdy card stock. Containers for larger, heavier, and less stiff collectible items such as magazines, present a problem of providing sufficient support in a cost-effective transparent container. Further, the heavy and flexible nature of such collectibles can cause container halves to separate where those halves are held together by a friction fit.

Collectors also like to display their collectible items. Prior art containers do not provide a convenient means for display of the collectible item on a surface such as a wall. Additionally, prior art containers intended for differently sized collectible items would themselves have differently sized exterior dimensions making a collection of such containers visually unwieldy.

SUMMARY OF THE INVENTION

The present invention provides a container for the protection and display of substantially planar collectible items such as magazines, cards, and newspapers that overcomes the problems of the prior art. In preferred embodiments, the present invention includes a lid that can engage a plurality of base units wherein respective base units can snugly receive different sized collectible items.

The base units include a receptacle that receives the collectible item. In preferred embodiments, the receptacle is substantially rectangular having a par width and a par height between lateral and longitudinal margins. The par height and par width correspond with the largest width and height of a collectible item that can be inserted into the receptacle. Sizer bars may be located along one or more receptacle margins to reduce the par width or the par height to accommodate a predetermined width or height of a collectible item, where that collectible item is less than the par width or par height, respectively. Preferably, sizer bars are provided along opposing margins in order to center the collectible item within the container for an aesthetically pleasing display.

The sizer bars adjust the interior dimensions of the receptacle in which the collectible item is stored. The lid fits on each base unit independently of the size or position of the sizer bars. Accordingly, exterior dimensions of the container are uniform throughout a set of containers for a category of collectible item thus providing a more aesthetically pleasing collection. Also, because the lid is interchangeable between base units that can snugly receive different sized collectible items, fewer lid molds, for forming lids, are necessary, thus reducing manufacturing costs for a family of containers.

To reduce costs of distribution and sales, the container of the present invention may be provided as a kit having a plurality of base units and a single lid for a particular category of collectible item. Representative categories include comic books, newspapers, or sport trading cards. Comic books, for example, have different dimensions depending upon the publisher. Base units of the present invention may be provided with sizer bars that accommodate the different sizes of comic books from the different publishers. A user may then buy a plurality of base units, and a smaller number of lids, to accommodate a comic book collection. The kit then provides a container that can accommodate different sizes of collectible items wherein the container has interchangeable lids to reduce material costs and inventory storage requirements.

Preferably, the base units are of unitary construction. Thus, although the sizer bars are described as discrete structure, in preferred embodiments, the sizer bars are discrete in concept only and are not physically discrete, but rather are portions of the unitarily constructed base units.

In addition, preferred embodiments of the present invention include friction posts that provide secure engagement of the lid and base units, even when the container is supporting relatively heavy and flexible collectible items such as magazines.

Preferred embodiments of the present invention also includes stiffening ribs to provide additional support for heavier, flexible collectible items. The stiffening ribs further work in conjunction with the friction posts to provide a secure container for collectible items.

Preferably, the receptacles of the present invention include enlarged recesses is at corners of the substantially rectangular receptacle in order to prevent damage to corners of the collectible item. Further, in preferred embodiments, an alignment divot is provided to indicate a mass centerline to assist a collector with locating a mounting device, such as a tack, onto the container to mount the container on a wall for display.

DESCRIPTION OF THE PREFERRED EMBODIMENTS

Figure 1:
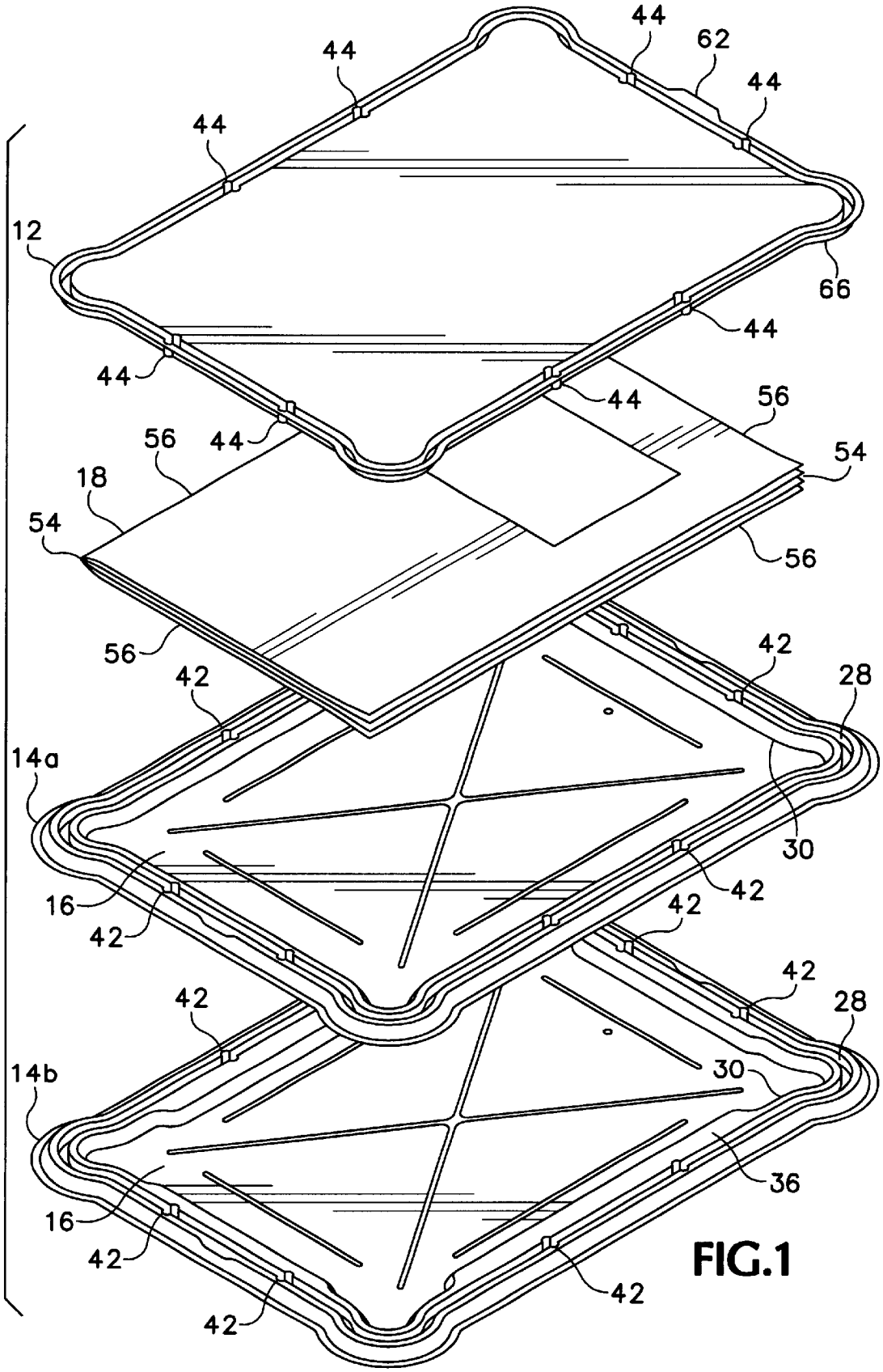
FIG. 1 is an exploded perspective view of a lid and base units of the present invention. The view of FIG. 1 also includes an exemplary collectible item in position to be stored in the present invention.

There is a large market for collectible items and collectors collect many different types of collectible items such as comic books, newspapers, magazines, trading cards, and photos. The value of a collectible item is often a function of its condition. Accordingly, protection of the collectible item is desirable.

In addition, some collectors tend to collect a large number of items. For example, a comic book collector may have many hundreds of titles at one time. Accordingly, collectors find it desirable to have containers that are aesthetically pleasing. Along this line, it is desirable that containers have substantially similar external dimensions, and appearance, even where the container is storing collectible items of different sizes. In addition, the uniform outer dimensions of a set of containers for a category of collectible items, allows distributors and collectors to store the containers (with collectible items therein) in uniformly sized boxes. The use of such uniform boxes for storing the containers is cost effective, convenient, and aesthetically pleasing as compared to using different sized boxes to store plural containers having collectible items therein.

With reference to the accompanying figures, preferred methods and devices for the present invention are explained. The exemplary embodiment of the present invention shown and depicted in the accompanying figures is for a container for magazines and soft-sided books. However, it is not the intention to limit the present invention to such collectible items. Rather, the present invention is applicable to a wide range of collectible items, and preferably flat planar collectible items. Accordingly, collectible items suitable for use in containers of the present invention include the aforementioned magazines and soft-sided books (such as comic books), and also photos, newspapers, trading cards, and other such items.

A preferred embodiment of the present invention is a container 10 having a lid 12 and base units 14*a* and 14*b* (collectively base units 14). The base units include a receptacle 16 that provides sufficient space to receive a collectible item, shown exemplarily as book 18. The lid 12 is sized to matingly engage the base units 14 so as to confine the collectible item 18 within the receptacle 16. Preferably, the lid, or base unit, or both, are fabricated of a clear material so that the collectible item can be clearly viewed while it is in the container 10. The container thus serves to protect and display the collectible item 18.

As noted, collectible items 18 may be available in a variety of sizes and it is desirable to protect the collectible item from wear and tear. The container 10 is better able to protect the collectible item when the collectible item fits snugly within the receptacle 16. And, in order to have the receptacle snugly fit a variety of sizes of collectible items, it is necessary that the receptacle have means for accommodating different widths and heights of collectible items.

Accordingly, the kit of FIG. 1 includes respective base units 14*a* and 14*b* that snugly receive differently sized collectible items. To this end, the base unit of 14*b* includes sizer bars 36, described in greater detail below, that reduce interior dimensions of the receptacle in order to more snugly receive smaller collectible items than can be snugly fit into the receptacle of base unit 14*a*.

Figure 2:
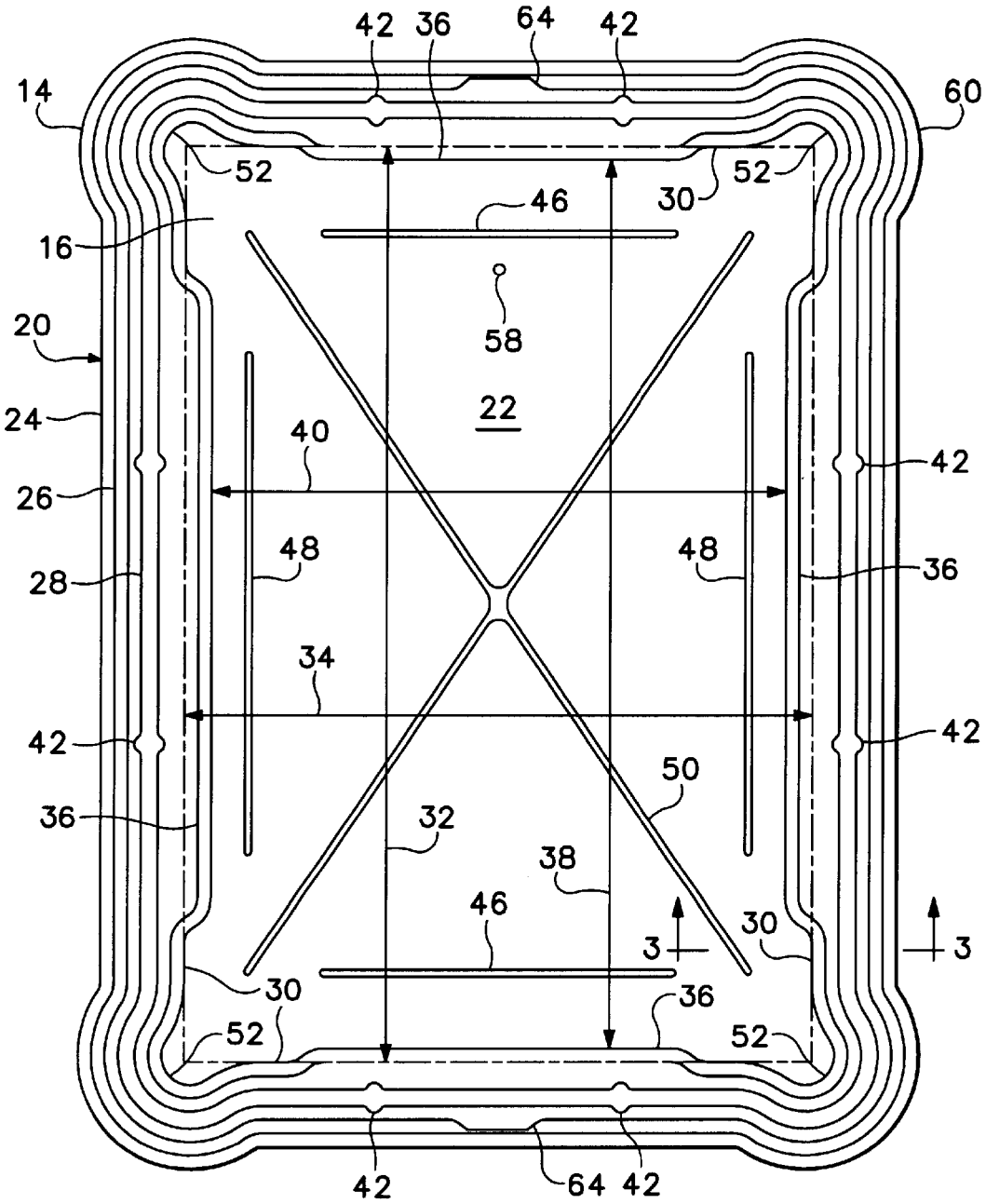
FIG. 2 is a top plan view of a preferred embodiment of an exemplary base unit of the present invention.
Figure 3:
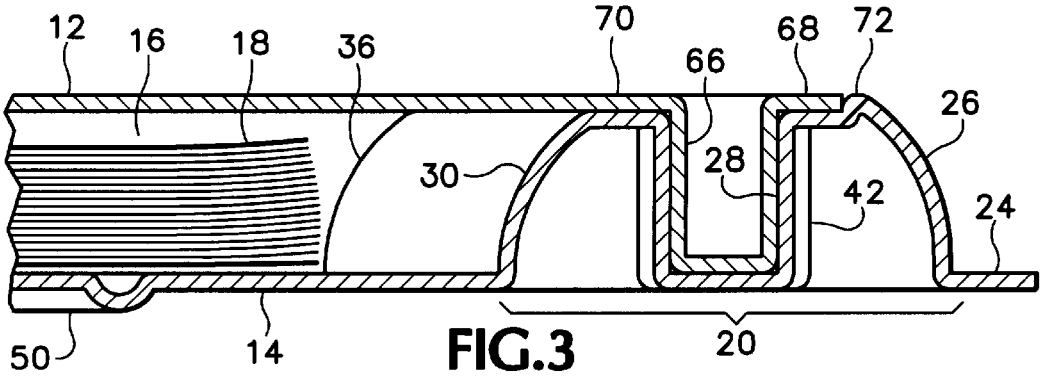
FIG. 3 is an enlarged cross sectional view of a portion of one base unit of FIG. 1 as viewed along the line the 3—3 of FIG. 1.

With particular reference to FIGS. 2 and 3, a preferred embodiment of a base unit of the present invention is described in greater detail. The base units 14 includes a flange portion 20 and a planar portion 22.

The flange portion 20 includes an outward extending skirt 24 that follows the outermost perimeter of the base unit and thereby defines the outermost dimensions of the base unit. Just inboard of the skirt 24 is a rolled edge 26 that leads to a mating channel 28 that receives a portion of the lid for mating engagement thereto. Continuing inboard from the mating channel 28, is a margin 30 of the receptacle 16. In this exemplary rectangular configuration of the receptacle 16, the margins 30 define a par height 32 and a par width 34 of the receptacle. This par height and par width represent the largest height and width of a collectible item 18 that can be accommodated in the receptacle 16.

Base units may further be provided with the sizer members (or sizer bars) 36 that extend inboard from the margins 30 of the receptacle 16. Preferably, the sizer members 36 are provided as equally sized pairs on opposed margins of the receptacle in order to center a collectible item within the container. Accordingly, although sizer members 36 may be provided along one margin only, it is preferred that sizer members be provided along two opposing margins 30 or along all four margins 30 of the receptacle as necessary to snugly accommodate a collectible item.

The sizer members 36 extend inboard from the margins 30 into the receptacle 16. Accordingly, the use, placement, arrangement, and size, of sizer members 36 does not effect the flange portion 20 or channel 28 of the base units 14. Thus, the external dimensions of the base unit and the channel 28 (that receives the lid 12) is common among all base units. The sizer members permit adjustment of the receptacle 16 so that different size collectible items 18 can be securely, and snugly, stored in the receptacle 16.

The sizer members 36 defined a mean height 38 and a mean width 40 of a receiving portion of the receptacle 16. Preferably, the mean height and mean width are substantially equal to, but no smaller than, a respective height and width of a collectible item 18 to be stored in the container 10. Thus, with reference to FIG. 1, the collectible item 18 is placed in the base unit 14*a* or 14*b* for best fit.

The mating channel 28 further includes post receptacles 42 for receiving posts 44 formed on the lid 12 (FIG. 1) as explained in greater detail below. The posts 44 are enlarged portions formed on the lid that resemble hollow posts.

The planar portion 22 of the base unit 14 includes stiffening ribs 46, 48, and 50. The stiffening ribs are arranged in an anesthetically pleasing pattern to provide additional rigidity to the planar portion to provide support for heavy, yet flexible, collectible items. It is intended, in this preferred embodiment, that the planar portion 22 of the base unit is the bottom, or backside, of the container. Accordingly, although the stiffening ribs are provided in an aesthetically pleasing, and distinctive, pattern, the ribs do not block the primary viewing and display of the collectible item when the item is confined in the container 10.

The receptacle includes recessed corners 52 so that margins 30 of the receptacle do not contact corners 54 of the collectible item when the collectible item in stored in the receptacle in order to protect the corners of the collectible item from damage. Thus, when a collectible item is located in the receptacle, only sides 56 of the collectible item contact the receptacle margins or sizer members, which offer greater area and thus less pressure so as to minimize the possibility of damage to the collectible item.

The base units 14 further include a mounting locator 58 that is located along a mass centerline (not shown) of the base unit. And, because the lid is symmetrical, the mounting locator 58 is also located along a mass centerline of the container 10 having the lid and base unit coupled. A mass centerline is an axis that bisects the base unit such that an equal mass is located on each side of the mass centerline. The base unit can define many mass centerlines, but for the purposes of this invention the relevant mass centerlines are substantially parallel to exterior margins 60 of the base unit, or are substantially vertical and horizontal when the collectible item 18 is located in the container 10 and the collectible item is oriented for a pleasing display.

In preferred embodiments, the mounting locator 58 is located along one mass centerline and above a center of mass of the container with a collectible item therein. The use of relative directions herein refer to an orientation of the container with a collectible item therein, wherein the collectible item is oriented as desired for display. Exemplarily, for English language comic books, a desired display orientation is such that the words on a front cover of the comic book are substantially horizontal.

A user uses the mounting locator 58 when displaying collectible items. If a user desires to mount the container 10, with a collectible item 18 therein, onto a wall surface (not shown) for display, the user may install a hanger device (not shown) onto a back surface of the base unit. Typical hanger devices are self adhesive picture hangers that include an adhesive portion and an opening that can fit over a nail or tack. The adhesive portion is then affixed to the back of the base unit and the opening is aligned with the mounting locator 58 so as to properly position the hanger device to insure the container with collectible item therein will hang from a wall surface as desired. Thereafter, the container having the affixed hanger device is positioned at a wall surface and the opening in the hanger device is placed over a nail or other stake that protrudes from the wall surface. The container with collectible item may then be aesthetically mounted to a wall surface to display the collectible item in a pleasing manner.

Alternatively, the container may by mounted to a wall surface by inserting a stake (not shown) through the base unit panel 22 at the mounting locator 58 and into the wall surface. The mounting locator thus assists the user with locating a point at which to place the stake so that the container with collectible item will hang from the wall surface as desired. The stake may be a thumb tack, or other piercing fastener, that can be driven through the base unit and into a wall surface.

Although one mounting locator 58 is shown in FIGS. 1 and 2, the base units may be provided with plural mounting locators on each of the major mass centerlines described above. In this manner, a collectible item may be displayed in different orientations as dictated by the nature of the collectible item. Exemplarily, a photo may have a landscape or portrait orientation and mounting a container on a wall surface would preferably accommodate either orientation.

Preferably, the lid 12 couples securely to the base units 14. The secure coupling can make it difficult to remove the lid from a base unit. To assist with removing the lid, a tab 62 is provided on the lid and the base units include a tab cutout 64 to accommodate the tab 62.

The lid 12 is preferably a unitarily constructed transparent material. The lid includes a circumferential lip 66 that fits matingly with the mating channel 28 of the base units 14. The lid further includes an outboard flange 68 that lies flush with a top portion of the rolled edge 26 to provide the container with a monolithic appearance when the lid and base unit are coupled together. That is, a top surface 70 of the lid is flush with a highest surface portion 72 of the base unit.

The lid lip 66 includes the posts 44 that are formed as slightly enlarged portions of the lip. The posts 44 engage the post receptacles 42 formed on the mating channel 28 of the base units 14 to provide a secure engagement of the lid and base unit.

The present invention also provides a method of protecting and displaying collectible items. With reference to FIG. 1, a user obtains a collectible item for storage and possible display. The user then determines which of a plurality of base units 14 best fit the collectible item so that the collectible item fits snugly in the base unit's receptacle 16. The collectible item is placed in the receptacle and the lid 12 is coupled to the base unit by inserting the lip 66 into the mating channel 28 so that the posts 44 align with the post receptacles 42. The lip is fully pushed into the channel as shown in FIG. 3.

This specification sets forth the best mode for carrying out the invention as known at the time of filing the patent application and provides sufficient information to enable a person skilled in the art to make and use the invention. The specification further describes materials, shapes, configurations and arrangements of parts for making and using the invention. However, it is intended that the scope of the invention shall be limited only by the language of the claims and the law of the land as pertains to valid U.S. patents.

What claimed is:

1. A container for protection of collectible items, comprising:

a lid;

a first base having a receptacle that includes first, second, third, and fourth margins wherein the receptacle has a first dimension that is the distance between the first and third margins and a second dimension that is the distance between the second and fourth margins, the receptacle including a first sizer bar that extends from a one of the first or second margins into the receptacle thereby reducing the first or second dimension, respectively, so that a collectible item can be securely received in the receptacle; and, a second base having a second base receptacle that includes first, second, third, and fourth margins wherein the second base receptacle has a first dimension that is the distance between the second base receptacle first and third margins and a second dimension that is the distance between the second base receptacle second and fourth margins, the second base receptacle including a second base first sizer bar that extends from a one of the second base receptacle first or second margins into the second base receptacle thereby reducing the first or second dimension of the second base receptacle, respectively, so that a collectible item can be securely received in the second base receptacle;

wherein the first sizer bars of the first and second bases are arranged so that the first base first and second dimensions are not equal to the second base first and second dimensions so that a collectible item of a predetermined size can fit snugly in the second base and not the first base, and wherein the lid can matingly couple to the first base or the second base to confine a collectible item in the respective receptacles.

2. The container of claim 1 wherein the lid includes a mating lip and the first and second bases include a mating channel that receives the mating lip.

3. The container of claim 2 wherein the mating lip includes enlarged portions and the mating channel includes expanded portions that receive the lip enlarged portions to securely couple the lid to the respective base portion.

4. The container of claim 1 wherein the first and second bases include a wall mount indicator that is located along a mass centerline of the respective bases.

5. The container of claim 1 wherein the first and second bases include a wall mount indicator that is located along a mass centerline of the container having a collectible item therein.

6. The container of claim 1 wherein the first base includes stiffening ribs to support flexible collectible items.

7. The container of claim 1 wherein a top surface of the lid is flush with a topmost surface of the first base when the lid is coupled to the first base.

8. The container of claim 1 wherein the first base and the second base have exterior dimensions and the exterior dimensions of the first and second bases are substantially equal.

9. The container of claim 1, wherein the first base, including the receptacle and first sizer bar, is of unitary construction.

* * * * *